United States Patent [19]

Hahn

[11] Patent Number: 4,919,199

[45] Date of Patent: Apr. 24, 1990

[54] MULTIPLE LOCKING STAKE FOR TUBE BUNDLE

[75] Inventor: Robert B. Hahn, Virginia Beach, Va.

[73] Assignee: The Atlantic Group, Inc., Norfolk, Va.

[21] Appl. No.: 296,592

[22] Filed: Jan. 13, 1989

[51] Int. Cl.[5] ..... F28F 1/00

[52] U.S. Cl. ..... 165/162; 165/172; 248/68.1

[58] Field of Search ..... 165/162, 172; 248/68.1

[56] References Cited

U.S. PATENT DOCUMENTS 2,317,572 4/1943 Whitt ..... 165/172

4,648,442 3/1987 Williams ..... 165/162

*Primary Examiner*—Robert G. Nilson

*Attorney, Agent, or Firm*—Fitzpatrick, Cella, Harper & Scinto

[57] ABSTRACT

An improved tube anti-vibration stake comprised of a longitudinally elongated, upwardly open member of a soft V configuration. The soft V is defined by a bend in a metal strip, preferably stainless steel, that is coincident with the longitudinal axis of the metal strip, so as to define upwardly extending sides that terminate at a distal end. Saddles are spaced perpendicular to the longitudinal axis of the stake and formed into the distal ends at positions which preferably are equal to the Pitch of a first horizontal row of tubes, against which each saddle will make contact as the tube is driven along a Lane between first or upper horizontal tube row and a second or lower horizontal tube row.

9 Claims, 1 Drawing Sheet

MULTIPLE LOCKING STAKE FOR TUBE BUNDLE

BACKGROUND OF THE INVENTION

1. Field of the Invention

An improved stake adapted to be driven between parallel rows of tubes within a condenser or heat exchanger bundle, in order to dampen vibration and provide support between rows of tubes. The invention resides in a tube stake that is elongated and of a soft V configuration, with a series of saddles upon each upper leg, so as to allow vertical tube expansions, without any substantial transverse motion of the tubes having lower surfaces engaging the series of saddles.

2. Brief Description of the Prior Art

It is well known that tube bundles used in heat exchanges and condensers are prone to sympathetic vibration and movement, as a consequence of temperature increases and density changes as a result of fluid velocity changes both inside and outside of the tubes. Such vibrations are of a oscillatory nature, and the oscillations can reach critical amplitudes and severely damage the tubes.

This well known problem has become more critical within condensers or heat exchangers wherein tubes originally comprised of Admiralty brass, or other relatively stiff materials, are replaced with lighter weight noble metal materials, such as titanium. A Design Guide published by the Heat Exchange Institute, 8th Edition, provides structural standards for differing tubing materials, wherein a maximum mid-span spacing between support plates perpendicular to the center line of rows of tubes is provided. By way of background, a permitted mid-span between support plates is typically on the order of between 30 inches and 50 inches, depending upon the inherent properties of the tube material, and various other design parameters such as pitch between center lines of each tube and the operating conditions of the condenser or heat exchanger. Since about 1955, with the advent of multi-spindle drills, approximately 49 holes typically are drilled in each of the tube support plates to be spaced longitudinally along the tubes, so as to define several bays. Such condensers are typically constructed so that the tube support plates space the tubes at the apices of an equilateral triangle, with the center line distance between adjacent tube being equal, in any direction. Accordingly, with respect to such condensers and heat exchangers, a free space or Lane is defined perpendicular to a line connecting the center lines of each tube which is the same, throughout the tube bundle array. Condenser tubes typically range in outer diameter between 0.75 inches and 1.25 inches, and the pitch between any two adjacent tubes is typically on the order of 0.875 inches, 1 inch, 1.125 inches, or 1.25 inches. As used hereinafter, the term Lane, is used to define the clearance space perpendicular to a line connecting the center line of two adjacent tubes. For example, for a condenser having tubes with an outer diameter of 0.875 inches, mutually spaced with a pitch dimension of 1.25 inches, and each tube having its center line at the apex of an equilateral triangle, there will be a Lane defined between adjacent horizontal tube rows of 0.208 inches, approximately. This nominal Lane dimension also is affected by the fact that the holes drilled in each tube support plate are slightly greater than the 0.875 outer dimension of each tube, with a typical tolerance for the hole in each tube plate being approximately 0.010 inches. Therefore, for a Lane of 0.208 inches, a stake may be able to separate horizontal rows of tubes up to 0.218 inches, before there is any deformation or bowing of an individual tube, at its mid-span between adjacent support plates in a given bay.

Within this environment, a representative prior art stake for a tube bundle is represented by Williams (U.S. Pat. No. 4,648,442). For further illustration of the environment for a tube stake of the present invention, Williams is incorporated herein by reference. Williams defines a support stake comprising a die-formed channel having a thickness or depth (measured from the top surface of the stake to the bottom channel surface) that essentially is identical to the Lane for a given condenser application.

The present invention is an improvement over the stake defined by Williams, in that the present invention teaches a stake with saddles defined along the upper surface of a longitudinal strip of metal bent upwardly substantially into a V shape so as to permit the lower surface of each tube in a given row to come to rest within a saddle, and thereby lock the stake against further longitudinal movement. A ligament is defined between each of the saddles defined on the upper or distal ends of the V configuration, and each saddle is spaced at the pitch of the condenser tubing. For example, where the pitch is 0.125 inches, and each tube in a horizontal row has an 0.875 inch outer diameter, the ligament will be less than 0.375 inches, with an exact dimension controlled by a desired spring-load effect. The included angle between each side of the V of the stake, and the original width of the metal strip, are used to define a vertical projection dimension that is greater than the Lane dimension. The vertical projection of the stake is measured from the bottom stake at the longitudinal bend line to the top of each distal end of the stake leg. The vertical distance between the bottom of the stake and the lowest, upper point of the upper surface of each saddle also is controllable, and is either equal to, or slightly greater than the Lane dimension. Hence, unlike the prior art stake of Williams, the present invention permits quick adjustment to the spring effect, and the amount of a vertical dimension interference fit in the Lane, simply by adjusting the included angle of the sides about longitudinal bend line; the original metal strip width; and the ligament dimension between saddles.

BRIEF SUMMARY OF THE INVENTION

The present invention comprises an improved tube anti-vibration stake comprised of a longitudinally elongated, upwardly open member of a soft V configuration, the soft V is defined by a bend proximate the midpoint of a metal strip, so that upwardly extending wings terminate at a distal end. Saddles are spaced perpendicular to the longitudinal axis of the stake, to provide spring contacts with the lower surfaces of a relatively upper horizontal row of tubes as the stake is driven longitudinally between upper and lower horizontal tube rows. A primary advantage of the present invention is that tubes within a condenser or heat exchanger do not have to be removed in order to permit driving of a stake perpendicular to a plane defined between the center lines of any two adjacent tubes. For convenience, the terms first or upper are equivalent, and the terms second or lower refer to a row of tubes parallel to, and immediately adjacent to a first or upper rows of tubes. Hence, the term horizontal is used as a convenient point of reference, and does not preclude use of a tube stake according to the present invention at any angle with respect to a tube bundle array.

A stake according to the present invention essentially comprises a longitudinally extending flat strip of metal. The strip is bent along a longitudinal midpoint to define a concave upper surface, and further formed to define transverse saddles at spaced points along upper surfaces of each side of the stake. The preferred strip material is stainless steel, such as AISI type 304 stainless steel, and typically is of a thickness in the range of between 0.028 inches and 0.035 inches. The metal strip preferably has an unbent width of approximately 1.00 to 2.00 inches, and is bent into a soft V configuration with an included angle of about 100° to 160°. The soft V configuration provides, along the longitudinally extending lower surface of the stake, a land having a transverse dimension preferably between 0.083 inches and 0.25 inches, when measured as a horizontal projection. Since the stake of the present invention is formed from a flat strip of steel and bent so as to define that land, the land actually initially will have an arcuate configuration. The projected initial width of the land actually may further deform from or be deformed to define contact forces between points on the lower surface of the stake, and points on the upper surfaces of each lower or second tube.

Either simultaneous with the bending step, or thereafter in a separate forming step, transverse saddles are defined with a center line spacing exactly equivalent to the pitch of the first or upper horizontal row of tubes against which the saddle will contact. As further disclosed hereafter with respect to a preferred embodiment, and as shown by the accompanying drawings, the radius of curvature for each saddle is no less than, and preferably is greater than, the radius of curvature of the tube against which it will engage. Further, each saddle has a smooth transition to the upper surface of the ligament between each saddle, to facilitate driving of the stake past a large number of horizontal tubes, without damaging the tubes or weakening the stake from the repetitive saddle/tube engagements. Typically, a tube bundle will have 20 or more tubes below which the leading saddle must sequentially pass, before coming to rest against the last tube in the bundle. Since the lower surface of the stake has a curved land substantially will slide against the upper surface of the second or lower horizontal tube row, the resistance to driving of a stake according to the present invention substantially is defined by the configuration of the saddle.

Accordingly, the present invention permits rapid and custom stake configuration changes for a large range of condenser tube configurations, without separate dies required to form a totally new dimension. The variables initially set are number of tubes; the pitch between Lane dimension. The degree of interference fit thereafter can be quickly adjusted by changing the width of the metal strip, the included angle between side walls, since the critical dimension of the vertical projection between the bottom of the stake and the lowest upper surface of the saddle can thereby modified.

The first object of the present invention is to provide an improved tube bundle stake that can relatively lock adjacent tubes of a first or upper tube row in the longitudinal direction of stake insertion, while permitting quick and rapid fabrication of stakes for different operating circumstances simply by changing the included angle between legs of the stake, and the width of the strip material which is used to form the stake according to the present invention. This first object of the present invention constitutes improvement over prior stakes wherein the stake was held with respect to horizontal tube rows simply by a wiring of stakes together, for example at each end of the stake, or by a hook arrangement at only one end of the stake, in the fashion illustrated by Williams. Unlike the Williams stake, the present invention is self-locking with respect to each of the adjacent tubes of a first or upper tube row. This additional horizontal locking complements the elimination of oscillatory motion in the vertical sense. As noted hereinbefore, tube vibration substantially is a function of intrinsic properties of the tube, with admiralty brass being less subject to oscillatory motion than modern noble tubing materials, such as titanium. Since the mid-span support requirements for a given tube material, is defined by the Heat Exchanger Institute Handbook (8the Edition), there is a structural standard for the support needed for any particular tube material.

A second and significant advantage of the present invention is the ability to qualify a condenser having a fixed space between support plates that was sufficient where the tubing was Admiralty brass, but insufficient where the tubing is replaced with titanium, for example. The present invention permits a series of customized tube stakes to be inserted after the titanium tubing has been installed, at the mid-span between the plates defining each bay. The stiffness needed for a stake quickly and easily is adjusted by varying the width of the sheet material used to define* the stake, and the included angle so as to achieve a desired vertical projection critical dimension that will provide the desired stiffness. Significant design flexibility therefore is afforded by the present invention, after retubing condensers with less rigid tubing. Titanium is coming into increasing use in condensers originally designed for stiffer tubes, such as Admiralty brass.

For a further understanding of the objects and advantages of the present invention, a preferred embodiment hereafter is described, wherein reference is made to the accompanying drawings.

DESCRIPTION OF THE PREFERRED EMBODIMENT

Figure 1:
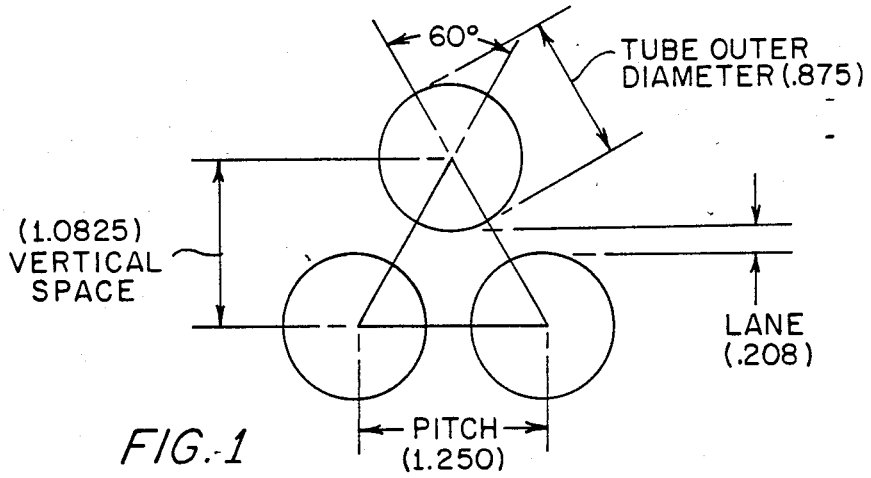
FIG. 1 is a schematic elevation view of a typical tube bundle arrangement showing pitch and Lane dimensions as defined with respect to the present invention.

FIG. 1 shows, schematically, a pattern for tubes that are spaced equilaterally from one another, and illustrates a view that is perpendicular to an end plate that defines a given bay of a condenser tube bundle, for example. As shown in FIG. 1, the tubes are spaced on centers, and this dimension is shown as PITCH, with a sample dimension of 1.25 inches. The resulting vertical space dimension between center lines of upper and lower parallel rows of tubes, then is 1.0825 inches. The Lane dimension shown as 0.208 inches thereafter is a function of the outer diameter of each tube, which is shown as 0.875 inches.

Figure 2:
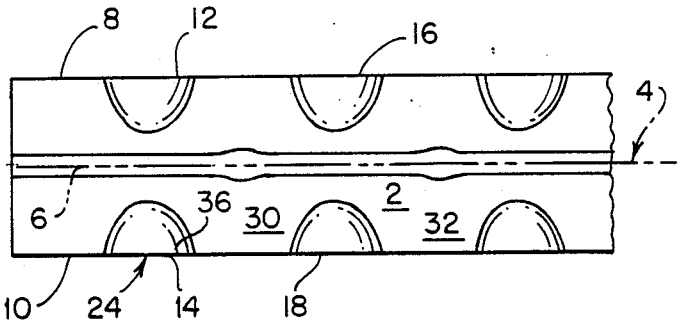
FIG. 2 is a top plan view showing a longitudinal section of a stake according to the present invention.

FIG. 2 is a top plan view of a preferred stake according to the present invention, looking downwardly upon the relatively concave upper surface of a flat metal strip that has been formed as described hereafter. The stake, 2, has a longitudinal axis, 4, and essentially comprises a proximate central section, 6, and two distal ends, 8, 10. Along each distal end there are formed pairs of transverse saddles, 12 and 14, 16 and 18, with these saddle pairs preferably being formed in operation simultaneously with bending of the flat metal strip into the soft V configuration as represented by the end elevation view of FIG. 3.

Each of the saddles is spaced longitudinally by a dimension which is equivalent to the Pitch of the relatively upper horizontal row of tubes against which it is intended to sequentially engage during a driving operation. Each saddle pair, 12 and 14, 16 and 18, preferably is formed by bending downward an arcuate section that intersects obliquely with the otherwise relatively planar legs extending to distal ends 8, 10, from either side of the central or approximate soft bend area, 6.

Figure 3:
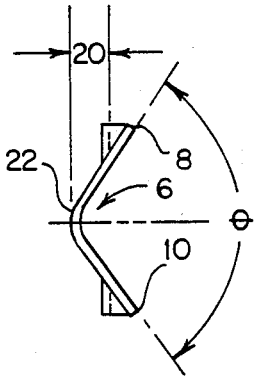
FIG. 3 is an end elevation view of a stake according to FIG. 2
Figure 4:
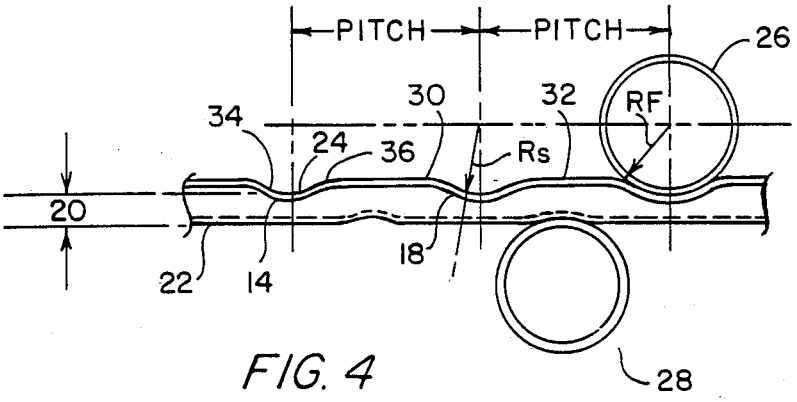
FIG. 4 is a side elevation view of the stake of FIG. 2, showing a schematic contact between a first and second row of tubes.

As shown in the side elevation of FIG. 4, each saddle defines a critical vertical projection dimension, 20, that is measured between the bottom rounded surface of the apex of the stake, 22, and the lowermost point on the upper surface of the saddle, 24. This critical dimension is equal to or greater than the Lane dimension, as hereinbefore defined. Further, as shown in FIG. 3, the inner radius of curvature, $R_s$, of each saddle is substantially equal to, or greater than the outer radius of curvature, $R_t$, of each tube, against which it is intended to engage. A representative first tube, 26, and second tube 28, are shown in place, in FIG. 4.

Further, as shown in FIGS. 3 and 4, each saddle has a transition section between its radius of curvature and the substantially horizontal and longitudinal ligaments 30, 32 that remain between each of the saddles. This transition section is defined at both intersections of the inner radius of curvature of a saddle, 24, with the supper surface of a ligament at either side. The transition sections, 34, 36, preferably also are substantially arcuate, so as to permit a relatively smooth sequential transition of a given tube from a given saddle to an immediately adjacent saddle, as the stake is being driven longitudinally below a first row of tubes. Since condensers typically have about 20 horizontal tubes defining a given row along a Lane, it can be appreciated that driving a stake longitudinally down a Lane will require the leading saddle to sequentially pass 20 tubes, and still maintain resiliency when it stops in its final location.

Figure 5:
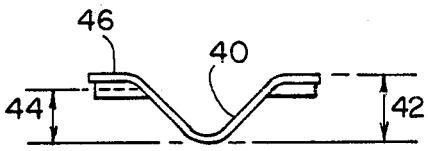
FIG. 5 is an end elevation view showing a modified version of the stake of FIGS. 2, 3 and 4.

A significant feature of the present invention is that the spring action defined by the overall structure of the stake simply can be adjusted by changing the included angle, $\phi$, that exists between the two walls of the stake, as shown in FIG. 3. Furthermore, the frictional effects defined by each saddle, and the ligaments between each saddle, significantly can be controlled by altering the overall width of the stake strip material after bending, as by creating the alternate ligament configuration shown in FIG. 5. As shown in FIG. 5, the vertical projected height of the modified stake, 40, is defined as 42, and is greater than the Lane dimension. The critical saddle vertical projection height, 44, will be at least equal to, and preferably slightly greater than, the Lane dimension. As discussed hereinbefore with respect to the embodiment of FIGS. 1–3, the difference between the vertical stake dimension and the critical vertical saddle dimension will affect the ease with which the stake can be driven, past a large number of tubes. As shown in FIG. 5, the ligament sections, 46, can also be bend down, so that a smaller relative distance can be defined between 42 and 44, (than in FIG. 3), for the same initial width of a metal strip.

In either embodiment, for a Lane dimension of 0.208 inches, there can be movement of the tubes, in the relative vertical direction, of up to 0.218 inches, given the typical oversize 0.010 inch tolerance of each hole drilled within the support plates. Further, since the stakes are intended to be used approximately mid-space within a bay as defined between successive tube support plates, larger bending moments can be applied to the tubes by virtue of an overall vertical height to a stake that exceeds the Lane dimensions, without damaging the tube bundle, or any individual tube.

As shown in FIGS. 3 and 5, an arcuate land is defined at the bottom surface of the stake, and the horizontal projection of that land preferably is between 0.0825 inches and 0.25 inches. The final contact between the bottom surface of the stake and the upper surface of a second or lower tube will tend to be greater than a line contact. Due to the soft V bend at the apex of either side of the stake, there is a tendency for a point on the lower surface of the stake to conform somewhat to the upper surfaces of a tube against which it slides and comes to rest and to distribute the spring loading effect of the stake over a surface area on the top of each tube that is more than a line contact. The soft V bend may also open somewhat, to distribute loads between each tube row.

The preferred stock material from which the present invention is formed is stainless steel, and AISI type 304 stainless steel is preferred. As shown by FIG. 3, the included angle $\phi$ may be between about 100°, and 160°, with the angle able to vary depending upon the desired spring force, and a change to critical dimension so that it is needed, after trying different interference fits for a given application. Further, as shown by FIG. 5, the forming of the saddles may further comprise a bending of the distal ends of each leg of the stake so as to define a flat land, 46, as part of each ligament. The transverse surface dimension of each land, 45, further can be used to adjust the overall frictional effect.

With reference to FIGS. 3 and 4, a stake is shown in position, between exemplary tubes, 26 and 28. For an AISI type 304 stainless steel material of 0.028 inch thickness, with an included angle of approximately 160°, the critical dimension, 20, is approximately 0.240 inches, where the Lane dimension is 0.208 inches. This critical dimension, 20, effectively spreads the Lane dimension between each tube slightly when in the final resting position. As also shown in FIGS. 3 and 4, the overall vertical projected height of the stake is greater than 0.240 inches, but still small enough so as to traverse a nominal Lane dimension of 0.028 inches without deforming the mid-span of the tube rows to a point where there would be plastic deformation, or damage to an upper or lower tube, in either horizontal row.

Having described a preferred embodiment of the present invention, it is to be understood that the invention is to be defined by the scope of the appended claims.

I claim:

1. A multiple locking stake adapted to be driven transversely in a Lane between first and second rows of tubes within a bundle, said stake comprising an elongated metal strip having a longitudinal axis, a bend along said longitudinal axis so as to define a proximate stake midpoint and upwardly extending legs that terminate at a distal end, wherein a plurality of saddles transverse to the longitudinal axis of the stake are formed at longitudinal locations within the distal ends of the legs with each saddle being separated by a ligament portion, so as to provide spring contact areas against lower surfaces of the first row of tubes and a sliding contact between a lower surface of the stake and upper surfaces of the second row of tubes as the stake is driven along said Lane in the intended use, wherein each saddle has an upper surface with a radius of curvature equal to or greater than the outer radius of curvature of the tubes of the first row, and each saddle has a transition section between that radius of curvature and a longitudinal surface of each adjacent ligament portion.

2. A multiple locking stake according to claim 1, wherein said bend proximate the midpoint of the metal strip defines a soft-V lower surface, that further comprises a radius of curvature for defining said sliding contact between a lower surface of the stake and upper surfaces of said second row of tubes and is deformed to define contact forces between points on the lower surface of the stake at points on upper surfaces of said second row of tubes.

3. A multiple locking stake according to claim 1, wherein the upper surface of the lowermost point of each saddle is spaced above the lower surface of the stake by a vertical projected dimension that is equal to, or greater than, the Lane dimension for said tube bundle.

4. A multiple locking stake according to claim 1, wherein the metal strip is bent into a soft-V configuration to define an included angle between each leg that is between approximately 100° and 160°.

5. A multiple locking stake according to claim 1, wherein a vertical height dimension of the stake, defined between the upper surface of the distal ends of the stake and the lower surface of the stake, is greater than the Lane dimension for said tube bundle.

6. A multiple locking stake according to claim 1, wherein said metal strip is stainless steel, has an unbent width of approximately 1.00 to 2.00 inches, is of stainless steel with a thickness between approximately 0.028 inches and 0.035 inches, and is bent into a soft-V configuration with an included angle of between 100° and 160°.

7. A multiple locking stake according to claim 7, wherein the longitudinally extending lower surface of the stake defines an arcuate land having a transverse dimension between approximately 0.083 inches and 0.25 inches, when measured as a horizontal projection.

8. A multiple locking stake according to claim 1, wherein said transverse saddles are defined on a longitudinal spacing that is equivalent to the Pitch of the first horizontal row of tubes against which each saddle is intended to make a spring contact.

9. A multiple locking stake adapted to be driven transversely in a Lane between first and second rows of tubes within a bundle, said stake comprising an elongated metal strip having a longitudinal axis, a bend along said longitudinal axis so as to define a proximate stake midpoint and upwardly extending legs that terminate at a distal end, wherein a plurality of saddles transverse to the longitudinal axis of the stake are formed at longitudinal locations within the distal ends of the legs with each saddle being separated by a ligament portion, so as to provide spring contact areas against lower surfaces of the first row of tubes and a sliding contact between a lower surface of the stake and upper surfaces of the second row of tubes as the stake is driven along said Lane in the intended use, wherein each ligament between saddles is formed to define a planar surface parallel to the longitudinal axis of the tube stake, so as to define a further sliding contact area with lower surfaces of the first horizontal tube row as the stake is being driven within the Lane.

* * * * *